US006938393B2

(12) United States Patent
Timmerman et al.

(10) Patent No.: US 6,938,393 B2
(45) Date of Patent: Sep. 6, 2005

(54) PACKAGING LINE AND METHOD FOR PACKAGING SEPARATE PRODUCTS IN A CONTINUOUS MANNER

(75) Inventors: Ronald Timmerman, Zaandam (NL); Roberto Tuyn, Zaanstad (NL)

(73) Assignee: Buhrs-Zaandam B.V., Zaandam (NL)

( * ) Notice: Subject to any disclaimer, the term of this patent is extended or adjusted under 35 U.S.C. 154(b) by 0 days.

(21) Appl. No.: 10/322,493

(22) Filed: Dec. 19, 2002

(65) Prior Publication Data

US 2003/0131567 A1 Jul. 17, 2003

(30) Foreign Application Priority Data

Dec. 19, 2001 (NL) ..... 1019610
Jul. 24, 2002 (NL) ..... 1021145

(51) Int. Cl.[7] ..... B65B 57/02

(52) U.S. Cl. ..... 53/66; 53/550; 53/504; 53/75; 53/64

(58) Field of Search ..... 53/550, 504, 66, 53/75

(56) References Cited

U.S. PATENT DOCUMENTS

| | | | | |
|---|---|---|---|---|
| 4,141,196 A | | 2/1979 | Blanding | |
| 4,299,151 A | | 11/1981 | Burton et al. | |
| 4,537,016 A | | 8/1985 | Shanklin et al. | |
| 5,329,745 A | | 7/1994 | Suga | |
| 5,330,067 A | * | 7/1994 | Gronnevik | 220/7 |
| 5,347,791 A | | 9/1994 | Ginzl et al. | |
| 5,351,464 A | | 10/1994 | Francioni | |
| 5,566,526 A | | 10/1996 | Suga | |
| 5,799,467 A | * | 9/1998 | Nankervis et al. | 53/450 |
| 5,894,709 A | * | 4/1999 | Fosshage | 53/450 |
| 6,050,057 A | * | 4/2000 | Tuyn et al. | 53/376.2 |
| 6,070,396 A | * | 6/2000 | Rinaldi et al. | 53/504 |
| 6,662,527 B1 | * | 12/2003 | Suga | 53/374.6 |

FOREIGN PATENT DOCUMENTS

| | | |
|---|---|---|
| CH | 680919 | 12/1992 |
| DE | 4310376 | 10/1993 |
| DE | 4418516 | 11/1995 |
| EP | 0 870 678 A1 | 10/1998 |
| GB | 1 261 179 | 1/1972 |
| GB | 2 297 074 A | 1/1995 |

* cited by examiner

*Primary Examiner*—Rinaldi I. Rada
*Assistant Examiner*—Brian Nash
(74) *Attorney, Agent, or Firm*—Birch, Stewart, Kolasch & Birch, LLP

(57) ABSTRACT

A packaging line and method for packaging separate products such as, for instance, magazines, CDs, DVDs and combinations thereof in a continuous manner, comprising:

a product assembling path (2) which is provided with a conveyor and feeders arranged therealong;

a packaging module provided with folding means for forming a packaging tube from a continuous packaging web, and a cross separating device for separating, in cross direction, separate packages filled with product from the packaging tube;

a control for controlling the discharge of the products from the feeders, for controlling the transport speed of the conveyors and for controlling the speed of the cross separating device, the control being designed for processing information about the length of each product to be packaged and for setting in-process, per product, the horizontal, and optionally, the vertical, stroke length of the cross separating device such that packages with different lengths for products of different lengths can be manufactured in random order.

55 Claims, 4 Drawing Sheets

PACKAGING LINE AND METHOD FOR PACKAGING SEPARATE PRODUCTS IN A CONTINUOUS MANNER

The invention relates to a packaging line for packaging separate products, such as, for instance, magazines, CDs, DVDs and combinations thereof in a continuous manner, the packaging line being provided with:

a product assembling path provided with a first conveyor and a number of feeders arranged along the conveyor;

a packaging module provided with folding means for forming a packaging tube from a continuous packaging web, a second conveyor for advancing a packaging tube being formed in the packaging module, and a cross separating device for separating, in cross direction, separate packages filled with product from the packaging tube, a control for controlling the supply of the product from the feeders, for controlling the transport speed of the conveyors and for controlling the speed of the cross separating device, the cross separating device comprising two separating elements, such as, for instance, sealing beams or cutting knives, of which separating elements a first one is arranged above the packaging tube and a second is arranged below the packaging tube, the separating elements passing through both a reciprocating vertical movement with a vertical stroke length and a reciprocating horizontal movement with a horizontal stroke length, while at least the horizontal stroke length is settable for processing both short and long products.

The invention also relates to a method for packaging separate products, such as, for instance, magazines, CDs, DVDs and combinations thereof in a continuous manner, wherein the method, while utilizing such a packaging line, assembles products in a product assembling path which is provided with a first conveyor and a number of feeders arranged along the conveyor, while in a packaging module, with the aid of folding means, a packaging tube is formed from a continuous packaging web, which packaging tube is advanced in the packaging module by a second conveyor, while with a cross separating device, separate packages filled with product are discharged from the packaging tube, while a control controls the supply of the products from the feeders as well as the transport speed of the conveyors and the speed of the cross separating device, while the cross separating device comprises two separating elements such as, for instance, sealing beams or cutting knives, of which separating elements a first one is arranged above the packaging tube and a second is arranged below the packaging tube, the separating elements passing through both a reciprocating vertical movement with a vertical stroke length and a reciprocating horizontal movement with a horizontal stroke length.

Such a packaging line and method are known from practice and have already been marketed by applicant for a great many years.

A problem of the known packaging line and method is that the packaging length of the package cannot be varied, at least not per product to be packaged. Once the known packaging line has been set, packages of equal length can be manufactured. However, it occurs that in the product assembling path, successive products are assembled of mutually different lengths. In the known packaging line, these products are accommodated in packages of equal length.

The invention contemplates a packaging line and a method without this drawback. To this end, the packaging line is characterized in that the control is designed for processing information about the length of each product to be packaged and for setting the horizontal stroke length per product, in-process, such that the packages with different lengths for products of different lengths can be manufactured in random order.

To this end, the method is characterized in that the control processes information about the length of each product to be packaged and sets the horizontal stroke length per product in-process, such that packages with different lengths for products of different lengths can be manufactured in random order.

As the control is designed for processing information about the length of each product to be packaged and for setting, per product, in-process, the horizontal stroke length, packages with different length for products of different lengths can be manufactured in random order. Due to this real-time conversion, an optimal flexibility of the packaging line and the method is obtained.

Moreover, the method used in the packaging line leads to a cutback of packaging material. Further, each product is accommodated in a fitting package with regard to the length. This latter is desired because a well-fitting package protects the product better and because, moreover, it is beneficial to the appearance of the packaged product.

To, also, be able to process products of different thickness, the packaging line is preferably characterized in that the control is also designed for processing information about the thickness of each product to be packaged and for setting, in-process, per product, the vertical stroke length, such that products of different thickness can be processed in random order.

Due to this feature, it is effected that the cross separating device functions optimally. The fact is that by keeping the vertical stroke length small, i.e. matching the product, a minimal time loss occurs for dead stroke, so that the duration of the separating operation, which is of importance in a sealing operation, can be geared to the desired sealing time as accurately as possible.

To enhance the flexibility of the packaging line and the method even more, it is particularly favorable, according to a further elaboration of the invention, when the control is designed for processing information about the width and/or thickness of each product to be packaged, while the folding means are provided with actuators with the aid of which the position of the folding means can be set in-process, while the control is designed for operating the actuators depending on the information about the width and/or thickness of each product, such that, from the continuous packaging web, a packaging tube of suitable dimensions is formed. With such a device and method, the position of the folding means can be set real-time, or in-process, and processing products of different width in random order or in succession becomes possible without having to stop the packaging line for resetting the folding means. Therefore, there is no longer any question of loss of production due to setting time which is particularly advantageous from an economic point of view.

According to a further elaboration of the invention, the packaging line and the method are characterized in that the control obtains the data about the dimensions of each product to be packaged from a database, in which database the dimension data of each product which is assembled in the product assembling path are stored.

With such a packaging line and/or method, without the presence of sensors, the desired in-process setting can be obtained. It is of importance, then, that the database contains data about the dimensions of the products present in the various feeders in the product assembling path. Generally, the database will also contain data concerning customers for whom the various products to be packaged are destined. Address data and data about the product composition desired by a specific customer can then be involved.

According to an alternative or additional further elaboration of the invention, the packaging line and the method can be characterized by sensors, which are arranged for picking up information about the dimensions of products which are assembled in the product assembling path, while the control derives the data about the dimensions of each product to be packaged from signals which are given off by the sensors mentioned.

The advantage of such an elaboration is that the database does not need to be loaded with data about the dimensions of products present in the various feeders. The fact is that the sensors provide this information and pass it on to the control, optionally via a database.

According to a few further elaborations of the invention, dimension data can also be used for setting modules in the post-packaging path such as, for instance, an ejecting station and/or a stacking station. Such further elaborations, which are described in the subclaims, contribute to the processing flexibility of the entire packaging line and the method as a whole.

According to a still further elaboration of the invention, the packaging line is characterized in that the cross separating device comprises a separating module having a first separating element and a second separating element, the separating module being provided with a conveyor arranged upstream of the separating elements and a conveyor arranged downstream of the separating elements, while at least the conveyor arranged downstream is designed for conveying a packaging tube containing products to be packaged in a transport plane, in a transport direction having a substantially constant speed, wherein the separating elements have a beam-shaped configuration, while a longitudinal center line of each separating element extends perpendicularly to the transport direction and parallel to the transport plane, the separating elements being designed for separating the packaging tube with the aid of the separating elements in cross direction between the products for forming separate packages containing products, the separating elements being designed for passing through a reciprocating movement along the transport direction in a synchronous manner, while at least a first separating element of the separating elements is arranged for movement in a direction perpendicular to the transport plane, so that the separating elements can be moved from each other and towards each other, while a first controllable drive effects the movement of the first separating element in the direction perpendicular to the transport plane, while a second controllable drive effects the synchronous, reciprocating movement of the separating elements along the transport direction. It is then preferred to also arrange the second separating element of the separating elements for movement in a direction perpendicular to the transport plane, while a third controllable drive effects the movement of the second separating element in the direction perpendicular to the transport plane.

As the drives are controllable, the path along which the movements proceed and the rate at which these movements are made can be varied in a simple manner. As a result, the movement of the first separating element in the direction perpendicular to the transport plane can be accurately controlled. This also holds for the movement of the second separating element in the direction perpendicular to the transport plane. Further, the movement of the separating elements in the direction of the transport plane can be accurately controlled. This offers enormous advantages with regard to the known device. For instance, in the known device, the horizontal movement of the separating elements was effected by a slide crank drive mechanism. As is known, such a mechanism does not have a linear velocity curve, so that, essentially, at no moment the horizontal movement runs perfectly synchronously to the transport speed of the conveyor located upstream of the separating elements. With the second controllable drive, the conveyor running perfectly synchronous to the transport speed of the conveyor located upstream of the separating elements can indeed be achieved, so that during separation of the packaging tube, i.e. during the cutting thereof in case of paper and during sealing through thereof in case of a plastic foil web, no forces are applied to the packaging tube in the transport direction. Conversely, if desired, during separation, some pull can be applied to the packaging tube or this packaging tube can be somewhat eased. These possibilities, which can be useful in particular when sealing plastic foil, lack completely in the known device. As the separation time is independent of the speed of the packaging line, separation can be finished even after the rest of the packaging line has stopped. Moreover, it is possible to effect a greater stroke and the separation time is independent of the speed of the packaging line. In particular when sealing, this is of great importance because thus, the sealing time can be accurately set. For instance, a thick foil can be sealed longer. Moreover, the independent control of the separation elements offers the possibility of packaging very long products; for instance even surf boards could be packaged in foil. Moreover, the controls can be provided with a memory in which the settings belonging to a particular job, for instance the packaging of a particular weekly, are stored. On reoccurrence of such a job, the packaging machine can directly retrieve the values belonging to that job and the packaging line is directly set, so that packaging can start directly. As, with modern controllable drives, such as, for instance controllable servomotors, the control takes place digitally, the settings will not shift, which was indeed the case with the known device as a result of clearance, wear or the like. It is also interesting that such a separating module can be tested stand-alone, without it forming part of the packaging line. In this manner, for instance, the sealing time for a particular foil can be tested outside the packaging line.

According to a further elaboration of the invention, the conveyor arranged downstream of the separating elements can be provided with a fourth controllable drive for driving the respective conveyor at a variable speed. Thus, the speed of the packaged product located downstream of the separating elements relative to the packaging tube located upstream of the separating elements can be varied, for instance for pulling the product, discharged downstream, loose from the packaging tube, which is necessary when sealing, at least can promote the separation process.

From the foregoing, it will be clear that the separating elements can comprise sealing beams to be heated, for separating a packaging tube of plastic foil. However, it is also possible that the separating elements comprise knives for separating a packaging tube of paper.

As the first, second and third drives realize a reciprocating movement whose stroke can be set and whose beginning and end can be set, so that the stroke and the path along which the reciprocating movement of the separating elements proceeds can be set, for instance the position of the point of contact at which the separating elements touch relative to the transport plane, can be varied. For instance, the point of contact can be positioned halfway of the thickness of the products to be packaged above the transport plane. What is thus effected is that between the products, a minimum amount of material is required for closing the package with the aid of the separating elements. In particular with thick products this can save a considerable amount of packaging material. Moreover, it can thus be effected that with thin products only a small stroke is made, which influences the speed of the device in a positive manner.

Further elaborations are described in the subclaims and will be clarified on the basis of an exemplary embodiment, with reference to the drawing.

Figure 1:
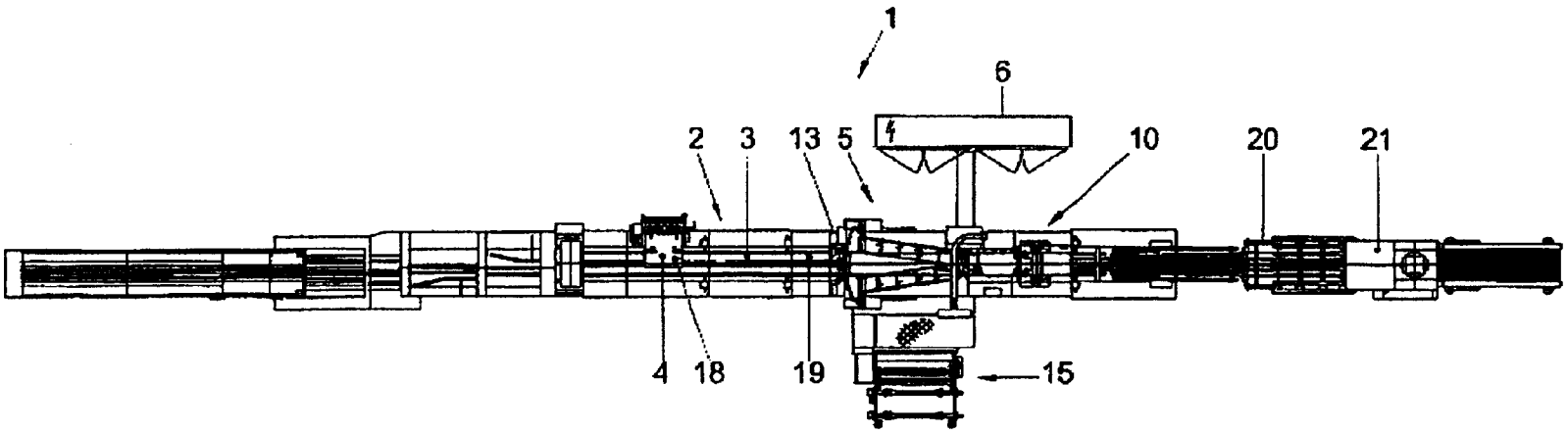
FIG. 1 shows a top plan view of an exemplary embodiment of a packaging line.
Figure 2:
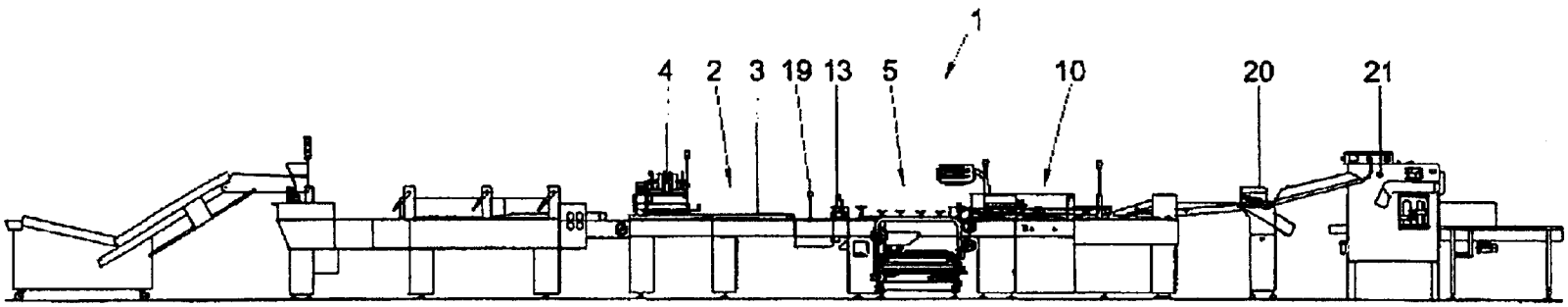
FIG. 2 shows a side view of the packaging line represented in FIG. 1.
Figure 3:
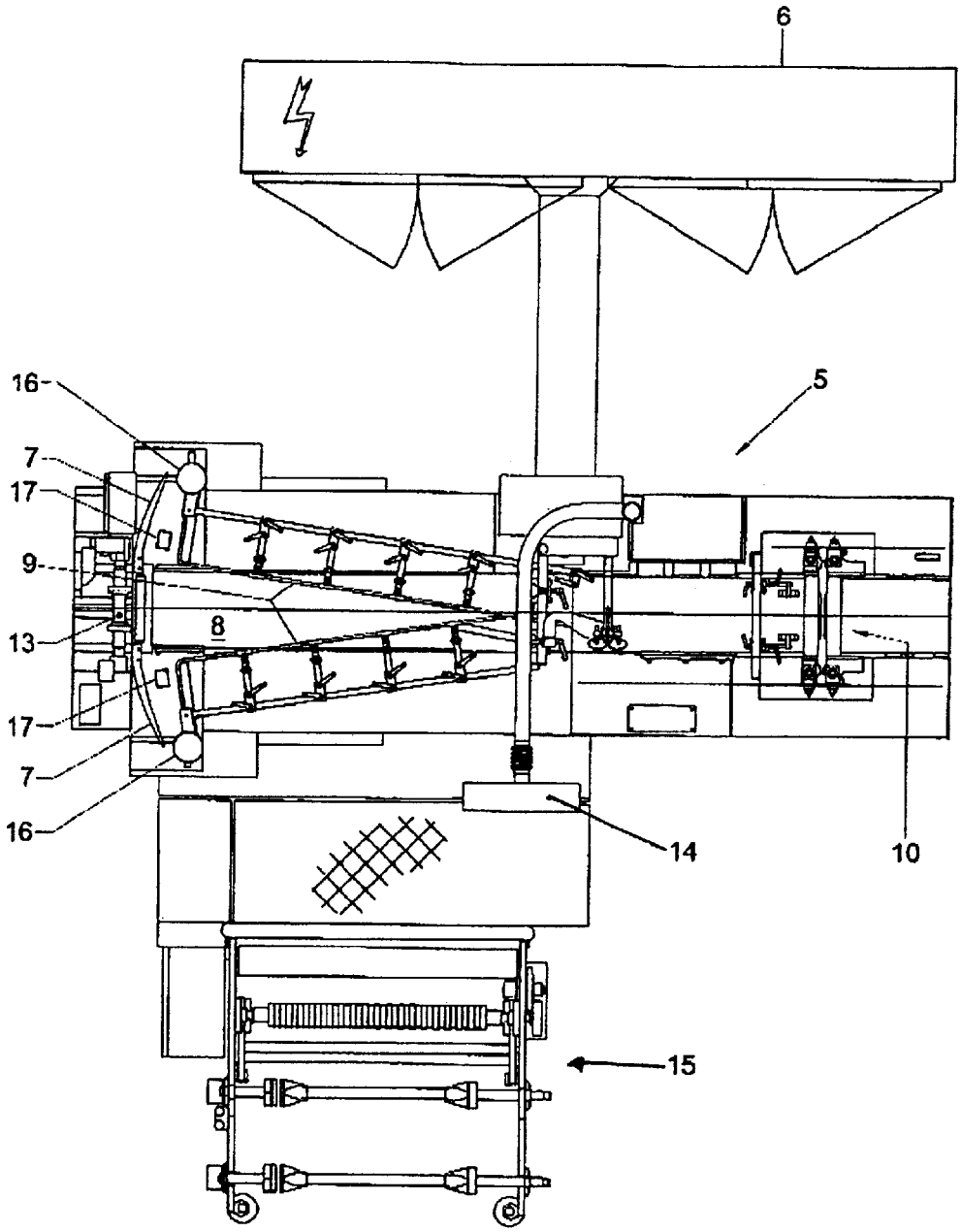
FIG. 3 shows a top plan view of a packaging module used in FIGS. 1 and 2.
Figure 4:
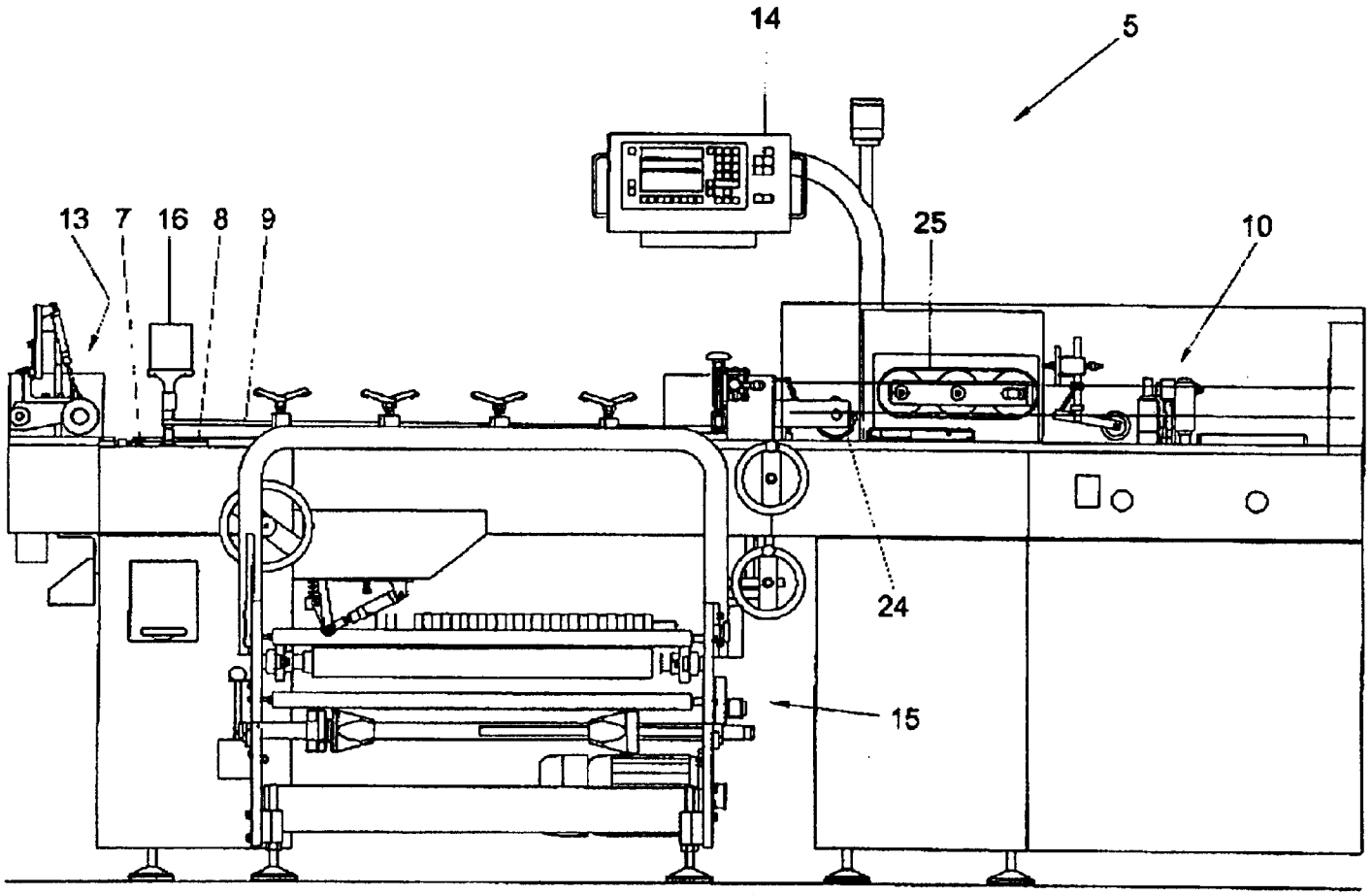
FIG. 4 shows a side view of the packaging module represented in FIG. 3.

FIGS. 1 and 2 show a packaging line 1 for packaging magazines, documents, CDs, DVDs or combinations thereof The packaging line 1 has a product assembling path 2 provided with a first conveyor 3 and a number of feeders 4 arranged along the conveyor. In this product assembling path 2, products are assembled which are built up, for example, from a number of documents. These assembled products then need to be packaged. This packaging takes place in a packaging module 5. In this packaging module 5, with the aid of folding means 7, 9, a packaging tube is formed from a continuous packaging web. The packaging tube is advanced by a second conveyor 8 in the packaging module 5 in a continuous manner but, optionally, at variable speed. With the aid of a cross separating device 10, separate packages filled with product are separated from the packaging tube. A control 6 controls the discharge of the products from the feeders 4 as well as the transport speed of the conveyors 3, 8 and the speed of the cross separating device 10. As clearly represented in FIG. 5, the cross separating device 10 is provided with two separating elements 101, 102, such as, for instance, sealing beams or cutting knives. A first separating element 101 is arranged above the packaging tube and a second separating element 102 is arranged below the packaging tube. The separating elements 101, 102 pass through both a reciprocating vertical movement with a vertical stroke length and a reciprocating horizontal movement with a horizontal stroke length. The Figures further show an unwinder 15 onto which a roll of packaging material can be placed and from which it can be unwound. The packaging material web can both be paper and sealable plastic foil. In the first case, the separating elements 101, 102 are knives, in the latter case the separating elements 101, 102 are sealing beam. FIGS. 3 and 4 farther show a product positioning station 13 with the aid of which the products assembled in the product assembling path 2 are placed on the packaging web, an operating console 14 and a longitudinal sealing element 24 for interconnecting the overlapping longitudinal edges of the packaging tube already formed there. Further, in FIG. 4, the pulling belt 25 is clearly visible with the aid of which the packaging tube with the products present therein is pulled forward.

According to the invention, the control 6 processes information about the length of each product to be packaged and the horizontal stroke length is set in-process, per product, such that packages with different lengths for products of different lengths can be manufactured in random order.

In the present exemplary embodiment, the control 6 also processes information about the thickness of each product to be packaged and the vertical stroke length is set, in-process, per product, such that products of different thickness can be processed in random order.

Further, in the present exemplary embodiment, the control 6 processes information about the width and/or thickness of each product to be packaged. The folding means 7, 9 are provided with actuators 17, 16, respectively, with the aid of which the position of the folding means 7, 9 can be automatically set in-process through operation of these actuators 16, 17 by the control 6. The operation of the actuators 16, 17 is dependent on the information about the width and/or thickness of each product, such that from the continuous packaging web, a packaging tube of suitable dimensions is formed.

In the present exemplary embodiment, the folding means 7, 9 comprise folding bars 9, whose position can be set in-process with the aid of actuators 16. The folding means 7, 9 further comprise a packaging web guiding element 7 over which a packaging web, fed from a bottom side, is guided in the horizontal plane of the second conveyor 8, and over which the forming of the packaging tube from the packaging web is initiated. The width and/or form of the packaging web guiding element 7 is set by two actuators 17, which actuators are operated in-process by the control 6, depending of the data available in the control 6 about width and/or thickness of a product to be packaged.

The control 6 can obtain the data about the dimensions of each product to be packaged from a database, in which database the dimension data of each product which is assembled in the product assembling path are stored.

In the present exemplary embodiment, the packaging line 1 is provided with sensors 18, 19 which sensors 18, 19 pick up information about the dimensions of products which are assembled in the product assembling path 2. The control 6 derives the data about the dimensions of each product to be packaged from signals which are given off by the sensors 18, 19 mentioned.

In the exemplary embodiment, each feeder 4 is provided with at least one sensor 18 which gives off the dimension information about the product present in the feeder 4 to the control 6. Further, at the first conveyor 3, a sensor 19 is arranged which obtains dimension information from products transported by the first conveyor 3.

Downstream of the cross separating device 10, an ejecting station 20 is arranged. On the basis of the dimension data of a respective product, the control 6 sets the ejecting function of the ejecting station 20. In the present exemplary embodiment, the ejecting station 20 is provided with a switch which can assume a feed-through position and an ejecting position. The control 6 is designed for controlling the duration in which the switch is held in the ejecting position depending on the length of the product known in the control 6. This duration can be varied in-process depending on the length of the products which has to be ejected.

Further downstream of the cross separating device 10, a stacker 21 is arranged. The stacker 21 is provided with actuators for automatically setting the stacker 21 depending on the dimensions of the products to be stacked. On the basis of the dimension data of a respective product, the control 6 controls, in-process, the actuators for setting the stacker 21.

Figure 5:
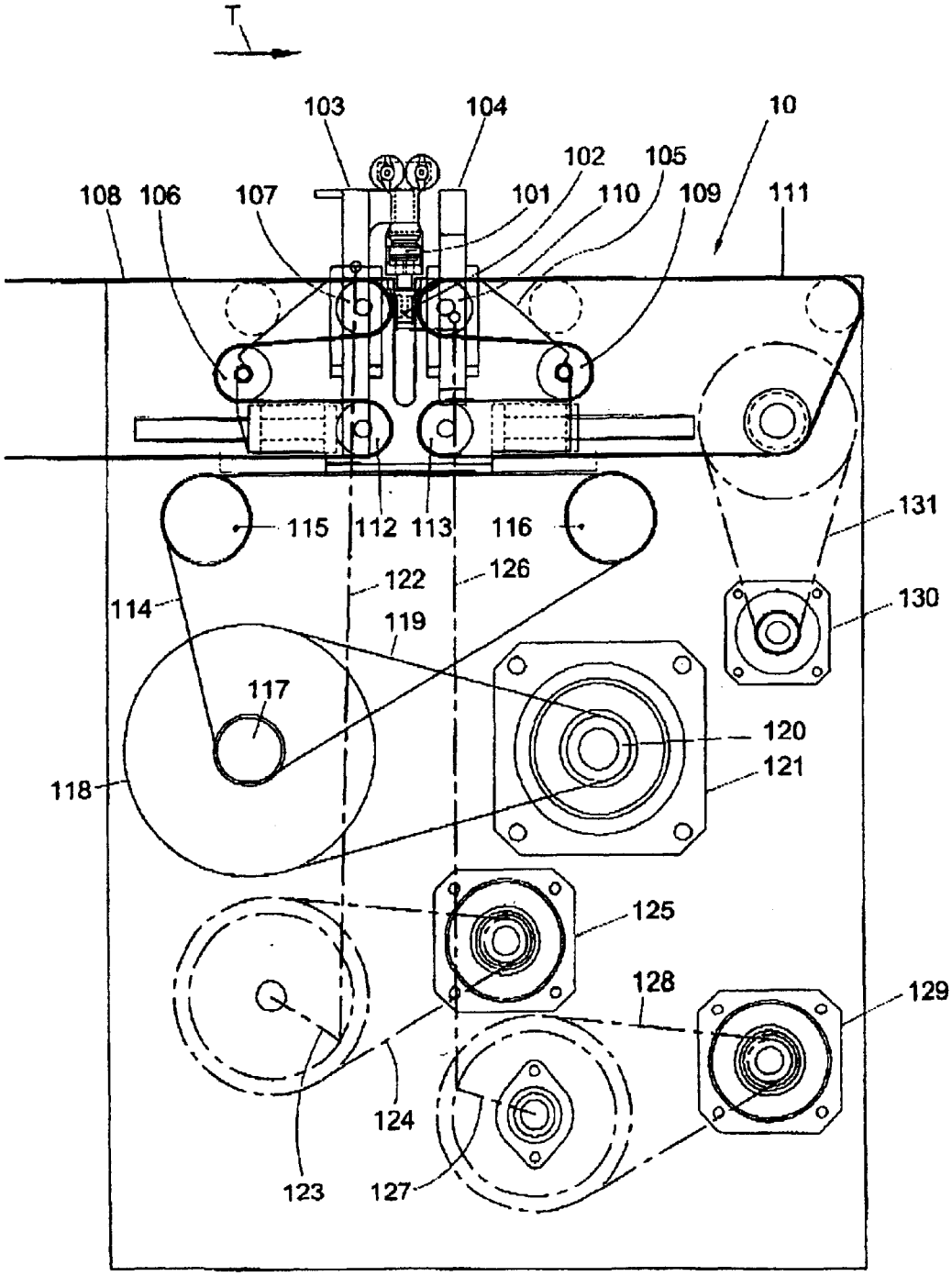
FIG. 5 shows an exploded view of the cross separating station which can be used in the exemplary embodiment shown.

It is noted that in the exemplary embodiment of the cross separating element 10 represented in FIG. 5, the respective module is provided with an upper sealing beam 101 and a lower sealing beam 102. The upper sealing beam 101 is arranged for upward and downward movement in a first guide 103. The lower sealing beam 102 is also arranged for upward and downward movement in a second guide 104. These guides 103 and 104 are connected, in their turn, to a frame plate 105 which can is arranged for reciprocating movement in the transport direction indicated with the arrow T. Moreover, this frame plate 105 bears two return wheels 106, 107 of a conveyor 108 arranged upstream of the sealing beams, and two return wheels 109, 110 of a conveyor 111 arranged downstream of the sealing beams 101, 102. The upstream conveyor 108 is further provided with a return wheel 112 arranged for rotation around a fixed axis. The downstream conveyor 111 too has such a return wheel 118 arranged for rotation around a fixed axis. As a result of this configuration of return wheels, the frame plate 105 can be moved to and from without this affecting the tension to the conveyor belt 108 or the conveyor belt 111. The frame plate 105 is connected to a toothed belt 114 which is guided over three return wheels 115, 116, 117. The return wheel 117 is connected to a drive wheel 118 over which a toothed belt 119 is guided which is connected to a drive shaft 120 of a controllable servomotor 121. Via a connecting rod 122, the upper sealing beam 101 is connected to a crank rod 123 or a like excenter. The crank rod 123 passes through a reciprocating movement which is imposed via a toothed belt or drive chain 124 to the crank rod by a driving motor 125 in the form of a controllable servomotor 125. Also for the lower sealing beam 102, a connecting rod 126 is present which, via a crank rod or like excenter 127 and a toothed belt 128 is driven by a servomotor 129 which is controllable. The downstream conveyor 111 is driven via a controllable servomotor 130 and a toothed belt 131 connected thereto. As all drives can be controlled independently of each other, the horizontal path of the sealing beams can be accurately set and the duration in which the sealing beams are pressed onto each other as well as the position at which the sealing beams will touch each other can be accurately set. Thus, the advantages which are described in the introduction to the specification are achieved. As modern servomotors are driven with digital control techniques, the values set for a particular job can be stored in the memory of the control, so that these values, when the respective job occurs again, can be directly retrieved, so that the desired setting is directly available.

However, it is also possible that the horizontal and vertical stroke are energized by one single motor and that the extent of the stroke can be influenced by adjusting a coupling mechanism which connects the horizontal movement to the vertical movement Naturally, for the automatic, in-process adjustment of the coupling mechanism, an actuator to be energized by the control 6 needs to be present.

It will be clear that the invention is not limited to the exemplary embodiment described but that various modifications are possible within the framework of the invention as defined by the claims.

What is claimed is:

1. A packaging line for packaging separate products in a continuous manner, comprising:

a product assembling path which is provided with a first conveyor and a number of feeders arranged along the conveyor;

a packaging module provided with folding means for forming a packaging tube from a continuous packaging web, a second conveyor for advancing the packaging tube which is being formed in the packaging module, and a cross separating device for separating, in cross direction, separate packages filled with product from the packaging tube; and a control for controlling the discharge of the products from the feeders, for controlling the transport speed of the conveyors and for controlling the speed of the cross separating device, the cross separating device comprising two separating elements, of which separating elements a first one is arranged above the packaging tube and a second one is arranged below the packaging tube, the separating elements passing through both a reciprocating vertical movement with a vertical stroke length and a reciprocating horizontal movement with a horizontal stroke length, while at least the horizontal stroke length is settable for processing both short and long products, wherein the control processes information about the length of each product to be packaged and sets the horizontal stroke length in-process, per product, such that packages with different lengths for products of different lengths can be manufactured in random order, and wherein the control obtains the data about the dimensions of each product to be packaged from a database, in which database the dimension data of each product, assembled in the product assembling path are stored.

2. The packaging line according to claim 1, wherein the control processes information about the thickness of each product to be packaged and sets the vertical stroke length in-process, per product, such that products of different thickness can be processed in random order.

3. The packaging line according to claim 1 or 2, wherein the control processes information about the width or thickness of each product to be packaged or the width and thickness of each product to be packaged, while the folding means are provided with actuators, with the aid of which the position of the folding means is automatically settable in-process, while the control controls the actuators depending on the information about the width or thickness of each product or the width and thickness of each product such that from the continuous packaging web, a packaging tube of suitable dimensions is formed.

4. The packaging line according to claim 3, wherein the folding means comprise a packaging web guiding element over which a packaging web fed from below is guided in the horizontal plane of the second conveyor and over which the forming of the packaging tube from the packaging web is initiated, while the width and/or form of the packaging web guiding element is settable with an actuator, which actuator is operated in-process by the control depending on the data available in the control about the width or thickness of a product to be packaged or the width and thickness of a product to be packaged.

5. The packaging line according to claim 3, wherein the folding means comprise folding bars, the position of which is settable, in-process, with the aid of actuators.

6. The packaging line according to claim 1, wherein the packaging line is provided with sensors, which are designed for picking up information about the dimensions of products which are assembled in the product assembling path, while the control derives the data about the dimensions of each product to be packaged from signals which are given off by said sensors.

7. The packaging line according to claim 6, wherein each feeder is provided with at least one said sensor for obtaining dimension information about the product present in the feeder.

8. The packaging line according to claim 6 or 7, wherein at the first conveyor, at least one said sensor is arranged for obtaining dimension information from the products conveyed by the first conveyor.

9. A packaging line for packaging separate products in a continuous manner, comprising:

a product assembling path which is provided with a first conveyor and a number of feeders arranged along the conveyor;

a packaging module provided with folding means for forming a packaging tube from a continuous packaging web, a second conveyor for advancing the packaging tube which is being formed in the packaging module, and a cross separating device for separating, in cross direction, separate packages filled with product from the packaging tube; and a control for controlling the discharge of the products from the feeders, for controlling the transport speed of the conveyors and for controlling the speed of the cross separating device, the cross separating device comprising two separating elements, of which separating elements a first one is arranged above the packaging tube and a second one is arranged below the packaging tube, the separating elements passing through both a reciprocating vertical movement with a vertical stroke length and a reciprocating horizontal movement with a horizontal stroke length, while at least the horizontal stroke length is settable for processing both short and long products, wherein the control processes information about the length of each product to be packaged and sets the horizontal stroke length in-process, per product, such that packages with different lengths for products of different lengths can be manufactured in random order, and wherein downstream of the cross separating device an ejecting station is arranged, while the control is designed for setting the ejecting function of the ejecting station on the basis of the dimension data of a respective product.

10. The packaging line according to claim 9, wherein the ejecting station comprises a switch which can assume a feed-through position and an ejecting position, the control controlling the duration in which the switch is held in the ejecting position depending on the length of the product to eject.

11. A packaging line for packaging separate products in a continuous manner, comprising:

a product assembling path which is provided with a first conveyor and a number of feeders arranged along the conveyor;

a packaging module provided with folding means for forming a packaging tube from a continuous packaging web, a second conveyor for advancing the packaging tube which is being formed in the packaging module, and a cross separating device for separating, in cross direction, separate packages filled with product from the packaging tube; and a control for controlling the discharge of the products from the feeders, for controlling the transport speed of the conveyors and for controlling the speed of the cross separating device, the cross separating device comprising two separating elements, of which separating elements a first one is arranged above the packaging tube and a second one is arranged below the packaging tube, the separating elements passing through both a reciprocating vertical movement with a vertical stroke length and a reciprocating horizontal movement with a horizontal stroke length, while at least the horizontal stroke length is settable for processing both short and long products, wherein the control processes information about the length of each product to be packaged and sets the horizontal stroke length in-process, per product, such that packages with different lengths for products of different lengths can be manufactured in random order, and wherein the cross separating device comprises a separating module having a first separating element and a second separating element, the separating module being provided with a conveyor arranged upstream of the separating elements and a conveyor arranged downstream of the separating elements, while at least the conveyor arranged upstream is operable to transport in a transport direction, at a substantially constant speed, a packaging tube containing products to be packaged in a transport plane, the separating elements having a beam-shaped configuration, a longitudinal center line of each separating element extending perpendicularly to the transport direction and parallel to the transport plane, while the separating elements are operable to separate the packaging tube with the aid of the separating elements in cross direction between the products for forming loose packages containing products, the separating elements being reciprocable along the transport direction, in a synchronous manner, while at least a first separating element of the separating elements is movable in a direction perpendicular to the transport plane, such that the separating elements can be moved away from each other and towards each other, while a first controllable drive effects the movement of the first separating element in the direction perpendicular to the transport plane, while a second controllable drive effects the synchronous reciprocating movement along the transport direction of the separating elements.

12. The packaging line according to claim 11, wherein a second separating element of the separating elements is movable in a direction perpendicular to the transport plane, while a third controllable drive effects the movement of the second separating element in the direction perpendicular to the transport plane.

13. The packaging line according to claim 11 or 12, wherein the conveyor arranged downstream of the separating elements is provided with a fourth drive for driving the respective conveyer at variable speed.

14. The packaging line according to at least claim 13, wherein the fourth drive is connected, via a toothed belt or chain, to the conveyor arranged downstream of the separating elements.

15. The packaging line according to claim 11, wherein the separating elements comprise sealing beams to be heated, for separating a packaging tube of plastic foil.

16. The packaging according to claim 11, wherein the separating elements comprise knives for separating a packaging tube of paper.

17. The packaging line according to claim 11, wherein the first drive realizes a reciprocating movement, the stroke of which is settable and the beginning and end of which reciprocating movement are settable, such that the stroke and the path along which the reciprocating movement of the first separating element proceeds is settable.

18. The packaging line according to claim 11, wherein the third drive realizes a reciprocating stroke, the stroke of which is settable and the beginning and end of which reciprocating movement are settable, such that the stroke and the path along which the reciprocating movement of the second separating element proceeds is settable.

19. The packaging line according to claim 11, wherein the second drive realizes a reciprocating movement, the stroke of which is settable and the beginning and end of which reciprocating movement are settable such that the stroke and the path along which the reciprocating movement of the separating elements proceeds is settable.

20. The packaging line according to claim 11, wherein the first and the second separating element are bearing mounted in a first and second guide, respectively, which guides are connected to a frame plate which, via a third guide running parallel to the transport plane, is moveably arranged for passing through said synchronous reciprocating movement, while the second drive is connected to said frame plate via a chain, or a toothed belt or a transmission.

21. The packaging line according to claim 20, wherein the first drive is connected, via a chain or toothed belt, to a first crank rod, which first crank rod is connected via a first connecting rod to the first separating element.

22. The packaging line according to claim 20 or 21, wherein the third drive is connected, via a chain or toothed belt, to a second crank rod, which second crank rod is connected, via a second connecting rod, to the second separating element.

23. The packaging line according to claim 20, wherein the conveyor arranged upstream of the separating elements, at a side proximal to the separating elements, is provided with three return wheels, one of which is arranged for rotation around a first fixed axis, while the other two are each arranged for rotation around an axis belonging to that return wheel, which two axes are connected to said frame plate.

24. The packaging line according to claim 20 or 23, wherein the conveyor arranged downstream of the separating elements, at a side proximal to the separating elements, is provided with three return wheels, one of which is arranged for rotation around a fixed axis, while the other two are arranged for rotation around an axis belonging to that respective return wheel, which two axes are connected to said frame plate.

25. The packaging line according to claim 11, wherein the first, second, third and fourth drives are servomotors, each of which is connected to a control belonging to the respective servomotor.

26. The packaging line according to claim 11, wherein the separating module or the packaging line the separation module is included in, is provided with sensors for measuring the thickness or length of the products or the thickness and length of the products, while the controls of the various drives set the stroke and the position of the stroke of the separating elements depending on the product dimensions observed by the sensors.

27. A packaging line for packaging separate products in a continuous manner, comprising:

a product assembling path which is provided with a first conveyor and a number of feeders arranged alone the conveyor;

a packaging module provided with folding means for forming a packaging tube from a continuous packaging web, a second conveyor for advancing the packaging tube which is being formed in the packaging module, and a cross separating device for separating, in cross direction, separate packages filled with product from the packaging tube; and a control for controlling the discharge of the products from the feeders, for controlling the transport speed of the conveyors and for controlling the speed of the cross separating device, the cross separating device comprising two separating elements, of which separating elements a first one is arranged above the packaging tube and a second one is arranged below the packaging tube, the separating elements passing through both a reciprocating vertical movement with a vertical stroke length and a reciprocating horizontal movement with a horizontal stroke length, while at least the horizontal stroke length is settable for processing both short and long products, wherein the control processes information about the length of each product to be packaged and sets the horizontal stroke length in-process, per product, such that packages with different lengths for products of different lengths can be manufactured in random order, and wherein downstream of the separating device, a stacker is provided, the stacker being provided with actuators for automatically selling the stacker depending on the dimensions of the products to be stacked, while the control controls, in-process, on the basis of the dimension data of a respective product, the actuators for selling the stacker.

28. A packaging line for packaging separate products in a continuous manner, comprising:

a product assembling path which is provided with a first conveyor and a number of feeders arranged along the conveyor;

a packaging module provided with folding means for forming a packaging tube from a continuous packaging web, a second conveyor for advancing the packaging tube which is being formed in the packaging module, and a cross separating device for separating, in cross direction, separate packages filled with product from the packaging tube;

a control, said control including means for controlling the discharge of the products from the feeders, means for controlling the transport speed of the conveyors and means for controlling the speed of the cross separating device, the cross separating device comprising two separating elements, of which separating elements a first one is arranged above the packaging tube and a second one is arranged below the packaging tube, the separating elements passing through both a reciprocating vertical movement with a vertical stroke length and a reciprocating horizontal movement with a horizontal stroke length, while at least the horizontal stroke length is settable for processing both short and long products, wherein the control includes means for processing information about the length of each product to be packaged and sets the horizontal stroke length in-process, per product, such that packages with different lengths for products of different lengths can be manufactured in random order.

29. The packaging line according to claim 28, wherein the control processes information about the thickness of each product to be packaged and sets the vertical stroke length in-process, per product, such that products of different thickness can be processed in random order.

30. The packaging line according to claim 28 or 29, wherein the control processes information about the width or thickness of each product to be packaged or the width and thickness of each product to be packaged, while the folding means are provided with actuators, with the aid of which the position of the folding means is automatically settable in-process, while the control controls the actuators depending on the information about the width or thickness of each product or the width and thickness of each product such that from the continuous packaging web, a packaging tube of suitable dimensions is formed.

31. The packaging line according to claim 30, wherein the folding means comprise folding bars, the position of which is settable, in-process, with the aid of actuators.

32. The packaging line according to claim 30, wherein the folding means comprise a packaging web guiding element over which a packaging web fed from below is guided in the horizontal plane of the second conveyor and over which the forming of the packaging tube from the packaging web is initiated, while the width and/or form of the packaging web guiding element is settable with an actuator, which actuator is operated in-process by the control depending on the data available in the control about the width or thickness of a product to be packaged or the width and thickness of a product to be packaged.

33. The packaging line according to claim 28, wherein the control obtains the data about the dimensions of each product to be packaged from a database, in which database the dimension data of each product, assembled in the product assembling path are stored.

34. The packaging line according to claim 28, wherein the packaging line is provided with sensors, which are designed for picking up information about the dimensions of products which are assembled in the product assembling path, while the control derives the data about the dimensions of each product to be packaged from signals which are given off by said sensors.

35. The packaging line according to claim 34, wherein each feeder is provided with at least one said sensor for obtaining dimension information about the product present in the feeder.

36. The packaging line according to claim 34 or 35, wherein at the first conveyor, at least one said sensor is arranged for obtaining dimension information from the products conveyed by the first conveyor.

37. The packaging line according to claim 28, wherein downstream of the cross separating device an ejecting station is arranged, while the control is designed for setting the ejecting function of the ejecting station on the basis of the dimension data of a respective product.

38. The packaging line according to claim 37, wherein the ejecting station comprises a switch which can assume a feed-through position and an ejecting position, the control controlling the duration in which the switch is held in the ejecting position depending on the length of the product to eject.

39. The packaging line according to claim 28, wherein the cross separating device comprises a separating module having a first separating element and a second separating element, the separating module being provided with a conveyor arranged upstream of the separating elements and a conveyor arranged downstream of the separating elements, while at least the conveyor arranged upstream is operable to transport in a transport direction, at a substantially constant speed, a packaging tube containing products to be packaged in a transport plane, the separating elements having a beam-shaped configuration, a longitudinal center line of each separating element extending perpendicularly to the transport direction and parallel to the transport plane, while the separating elements are operable to separate the packaging tube with the aid of the separating elements in cross direction between the products for forming loose packages containing products, the separating elements being reciprocable along the transport direction, in a synchronous manner, while at least a first separating element of the separating elements is movable in a direction perpendicular to the transport plane, such that the separating elements can be moved away from each other and towards each other, while a first controllable drive effects the movement of the first separating element in the direction perpendicular to the transport plane, while a second controllable drive effects the synchronous reciprocating movement along the transport direction of the separating elements.

40. The packaging line according to claim 39, wherein a second separating element of the separating elements is movable in a direction perpendicular to the transport plane, while a third controllable drive effects the movement of the second separating element in the direction perpendicular to the transport plane.

41. The packaging line according to claim 39 or 40, wherein the conveyor arranged downstream of the separating elements is provided with a fourth drive for driving the respective conveyer at variable speed.

42. The packaging line according to at least claim 41, wherein the fourth drive is connected, via a toothed belt or chain, to the conveyor arranged downstream of the separating elements.

43. The packaging line according to claim 39, wherein the separating elements comprise sealing beams to be heated, for separating a packaging tube of plastic foil.

44. The packaging according to claim 39, wherein the separating elements comprise knives for separating a packaging tube of paper.

45. The packaging line according to claim 39, wherein the first drive realizes a reciprocating movement, the stroke of which is settable and the beginning and end of which reciprocating movement are settable, such that the stroke and the path along which the reciprocating movement of the first separating element proceeds is settable.

46. The packaging line according to claim 39, wherein the third drive realizes a reciprocating stroke, the stroke of which is settable and the beginning and end of which reciprocating movement are settable, such that the stroke and the path along which the reciprocating movement of the second separating element proceeds is settable.

47. The packaging line according to claim 39, wherein the second drive realizes a reciprocating movement, the stroke of which is settable and the beginning and end of which reciprocating movement are settable such that the stroke and the path along which the reciprocating movement of the separating elements proceeds is settable.

48. The packaging line according to claim 39, wherein the first and the second separating element are bearing mounted in a first and second guide, respectively, which guides are connected to a frame plate which, via a third guide running parallel to the transport plane, is moveably arranged for passing through said synchronous reciprocating movement, while the second drive is connected to said frame plate via a chain, or a toothed belt or a transmission.

49. The packaging line according to claim 48, wherein the first drive is connected, via a chain or toothed belt, to a first crank rod, which first crank rod is connected via a first connecting rod to the first separating element.

50. The packaging line according to claim 48 or 49, wherein the third drive is connected, via a chain or toothed belt, to a second crank rod, which second crank rod is connected, via a second connecting rod, to the second separating element.

51. The packaging line according to claim 48, wherein the conveyor arranged upstream of the separating elements, at a side proximal to the separating elements, is provided with three return wheels, one of which is arranged for rotation around a first fixed axis, while the other two are each arranged for rotation around an axis belonging to that return wheel, which two axes are connected to said frame plate.

52. The packaging line according to claim 48 or 51, wherein the conveyor arranged downstream of the separating elements, at a side proximal to the separating elements, is provided with three return wheels, one of which is arranged for rotation around a fixed axis, while the other two are arranged for rotation around an axis belonging to that respective return wheel, which two axes are connected to said frame plate.

53. The packaging line according to claim 39, wherein the first, second, third and fourth drives are servomotors, each of which is connected to a control belonging to the respective servomotor.

54. The packaging line according to claim 39, wherein the separating module or the packaging line the separation module is included in, is provided with sensors for measuring the thickness or length of the products or the thickness and length of the products, while the controls of the various drives set the stroke and the position of the stroke of the separating elements depending on the product dimensions observed by the sensors.

55. The packaging line according to claim 28, wherein downstream of the separating device, a stacker is provided, the stacker being provided with actuators for automatically setting the stacker depending on the dimensions of the products to be stacked, while the control controls, in-process, on the basis of the dimension data of a respective product, the actuators for setting the stacker.

* * * * *